US006996362B2

(12) United States Patent
Kellie et al.

(10) Patent No.: US 6,996,362 B2
(45) Date of Patent: Feb. 7, 2006

(54) FUSER SYSTEM AND METHOD FOR ELECTOPHOTOGRAPHY INCLUDING MULTIPLE FUSING STATIONS

(75) Inventors: Truman F. Kellie, Lakeland, MN (US); Charles W. Simpson, Lakeland, MN (US); William D. Edwards, New Richmond, WI (US); Steven C. Jensen, Maplewood, MN (US)

(73) Assignee: Samsung Electronics Company, Suwon (KR)

( * ) Notice: Subject to any disclaimer, the term of this patent is extended or adjusted under 35 U.S.C. 154(b) by 109 days.

(21) Appl. No.: 10/652,898

(22) Filed: Aug. 30, 2003

(65) Prior Publication Data

US 2005/0047836 A1 Mar. 3, 2005

(51) Int. Cl.
*G03G 15/01* (2006.01)

(52) U.S. Cl. ..... 399/328; 399/330; 399/331

(58) Field of Classification Search ..... 399/328, 399/329, 330, 331; 219/216
See application file for complete search history.

(56) References Cited

U.S. PATENT DOCUMENTS 4,897,691 A * 1/1990 Dyer et al. ..... 399/336
4,973,824 A 11/1990 Ohashi et al.
5,436,711 A 7/1995 Hauser
6,223,016 B1 * 4/2001 Jia et al. ..... 399/327
2003/0035662 A1 2/2003 Pang et al.
2004/0175208 A1 * 9/2004 Ichida et al. ..... 399/302

* cited by examiner

*Primary Examiner*—Hoan Tran
(74) *Attorney, Agent, or Firm*—Kagan Binder, PLLC

(57) ABSTRACT

A fusing apparatus for fixing images made from a liquid toner onto a substrate using an electrophotographic process, the apparatus including a first fusing station having first and second prefusing rollers, the second prefusing roller contacting the first prefusing roller to create a first nip area, wherein at least one of the prefusing rollers is heated to a temperature that provides a prefusing temperature within the first nip area, and a second fusing station spaced from the first fusing station and having first and second final fusing rollers, the second final fusing roller contacting the first final fusing roller to create a second nip area, wherein at least one of the final fusing rollers is heated to a temperature that provides a fusing temperature within the second nip area, wherein the fusing temperature of the second nip area is higher than the prefusing temperature of the first nip area.

24 Claims, 2 Drawing Sheets

FUSER SYSTEM AND METHOD FOR ELECTOPHOTOGRAPHY INCLUDING MULTIPLE FUSING STATIONS

TECHNICAL FIELD

The present invention relates fusing devices and systems for use with electrophotographic processes and particularly relates to the use of such devices and systems with liquid toner materials.

BACKGROUND OF THE INVENTION

Electrophotography forms the technical basis for various well-known imaging processes, including photocopying and some forms of laser printing. One basic electrophotographic process involves placing a uniform electrostatic charge on a photoreceptor, and then exposing the photoreceptor to activating electromagnetic radiation in particular areas that correspond to an image to be printed or transferred. The electromagnetic radiation, which may also be referred to as "light", may include infrared radiation, visible light, and ultraviolet radiation, for example. This exposure of the photoreceptor to light dissipates the charge in the exposed areas to form an electrostatic latent image. The resulting electrostatic latent image is developed with a toner, and then the toner image is transferred from the photoreceptor to a final substrate, such as paper, either by direct transfer or via an intermediate transfer material. The direct or intermediate transfer of an image typically occurs by one of the following two methods: elastomeric assist (also referred to herein as "adhesive transfer") or electrostatic assist (also referred to herein as "electrostatic transfer"). Elastomeric assist or adhesive transfer refers generally to a process in which the transfer of an image is primarily caused by surface tension phenomena between a photoreceptor surface and a temporary carrier surface or medium for the toner. The effectiveness of such elastomeric assist or adhesive transfer is controlled by several variables including surface energy, temperature, pressure, and toner rheology. Electrostatic assist or electrostatic transfer refers generally to a process in which transfer of an image is primarily affected by electrostatic charges or charge differential phenomena between the receptor surface and the temporary carrier surface or medium for the toner. Electrostatic transfer, like adhesive transfer, is controlled by surface energy, temperature, and pressure, but the primary driving forces causing the toner image to be transferred to the final substrate are electrostatic forces. After the toned image is transferred by either type of transfer method, electrophotographic processes may further include the processes of fusing the transferred image to the substrate, cleaning the photoreceptor, and erasing any residual charge on the photoreceptor to prepare the system for the transfer of a new image.

In some common electrophotographic processes, the structure of a photoreceptor is a continuous belt, which can be supported and circulated by rollers or a rotatable drum, for example. Photoreceptors generally have a photoconductive layer that transports charge (either by an electron transfer or charge transfer mechanism) when the photoconductive layer is exposed to activating electromagnetic radiation or light. The photoconductive layer is generally affixed to an electroconductive support, such as a conductive drum or a substrate that is vapor coated with aluminum or another conductor. The surface of the photoreceptor can be either negatively or positively charged so that when activating electromagnetic radiation strikes certain regions of the photoconductive layer, charge is conducted through the photoreceptor to neutralize, dissipate or reduce the surface potential in those activated regions. An optional barrier layer may be used over the photoconductive layer to protect the photoconductive layer and thereby extend the service life of the photoconductive layer. Other layers, such as adhesive layers, priming layers, or charge injection blocking layers are also used in some photoreceptors. A release layer may also be used to facilitate transfer of the image from the photoreceptor to either the final substrate, such as paper, or to an intermediate transfer element.

Typically, a toner image that corresponds to the electrostatic latent image on the photoreceptor may be formed by providing a positively charged toner that is attracted to those areas of the photoreceptor that retain a less positive charge after exposure to electromagnetic radiation. Two commonly available general types of toners are referred to as dry toners and liquid toners. Dry toners will often be a powdered material comprising a blend or association of polymer and colored particulates, such as carbon for a black image, and liquid toners will often be a liquid material of finely divided solids dispersed in an insulating liquid that is frequently referred to as a carrier liquid. Generally, the carrier liquid may be a hydrocarbon that has a relatively low dielectric constant (e.g., less than 3) and a vapor pressure sufficiently high to ensure rapid evaporation of solvent following deposition of the toner onto a photoreceptor, transfer belt, and/or receptor sheet. Rapid evaporation is particularly important for cases in which multiple colors are sequentially deposited and/or transferred to form a single image.

Liquid toners can provide advantages over dry or powdered toners in certain applications because they are capable of producing higher resolution images while requiring lower energy for image fixing than dry toners. In addition, it is preferable for the toned image on the final substrate to be fixed to the substrate in such a way that it is resistant to removal in a variety of uses, abuses, and environmental conditions. However, the ink of the toned image that is deposited on the final substrate is often fragile and may not bear the attack of scratching or rubbing by outside forces such as human finger contact or such as erasure by a rubber pencil eraser, which may be referred to as poor "erasure resistance." Furthermore, transferred inks having residual tack or stickiness may also undesirably stick to other final substrates when placed in a stack, which can cause image damage when adjacent substrates are separated from one another when a portion of the image peels away from the transferred image and onto another surface. This tendency of the image to undesirably transfer from one substrate to an adjacent substrate may be referred to as poor "blocking resistance."

In order to render the inks to be adequately resistant to external forces such as blocking and erasure, it is sometimes desirable to heat the ink to an elevated temperature by contacting the surface of the final substrate to which the ink has been transferred with heat, such as a heated roll. Examples of fuser configurations having a single heated roller with at least one non-heated pressure roller for pressing a toned image toward the heated roller can be found in U.S. Pat. Nos. 4,806,097 (Palm et al.), 5,893,019 (Yoda et al.), and 5,897,294 (Yoda et al.). This process is commonly referred to as "fusing" and is often achieved by subjecting the final paper print to a heat source immediately after the transfer of ink to paper or another substrate. In the case of liquid toners, the use of heat can facilitate fixation of the ink by causing evaporation of the liquid portion of the toner. The heat also can serve to melt the toner particles onto the final substrate for permanence and durability.

Many types of heat sources may be used to fuse inks to paper or other mediums, such as a heated belt, a heated drum, or heated air, for example. Because some toners melt at different temperatures than others, the temperature necessary to adequately fuse the toner particles is usually customized to the chemical properties of the toner. If the temperature of the heating roller or element is too high, the toner may stick to the roller or other element and then be transferred back to the final substrate on a subsequent revolution of a roll, for example. This problem is known as "hot offset" and can often be cured by lowering the temperature of the roller. If the temperature of the heating roller or element is too cool, however, the toner particles may fail to fuse to the final substrate, and may also transfer to the roller or element, and possibly to the final substrate on a subsequent revolution, which may be referred to as "cold offset." Thus, to achieve a proper transfer of toner in such a way that the ink can adequately bond to the final substrate, the heater roller or element should desirably be maintained at a relatively constant temperature within a defined range. This may be difficult to achieve, however, with certain types of heating systems.

Fusing images made with liquid toners thus presents special challenges as compared to the fusing of images created using other toner materials. First, the constant contact of liquid toner with a heated roller or element essentially creates a constant cooling "bath," which may make it more difficult to maintain an adequate and relatively constant temperature for both eliminating the carrier liquid and fusing the image. Second, many of the devices and low surface energy materials used for dry toner fusing are not formulated to be used in a system where liquid or steam can penetrate, pool, run, or be imbibed, as is sometimes the case in electrophotographic systems using liquid toners. Third, traditional fusing, which is often used for dry toner systems where the final substrate is heated with the image facing the heating element, may not allow a sufficient amount of the evaporated carrier liquid to move away from the heating element, which may cause the carrier to undesirably re-condense on the final substrate and other components of the printing device. It is therefore desirable to provide devices, systems, and methods of fusing liquid toners that provide consistent, high quality images on a final substrate.

SUMMARY OF THE INVENTION

In one aspect of this invention, a fusing apparatus is provided for fixing images made from a liquid toner onto a substrate using an electrophotographic process. The apparatus includes a first fusing station having first and second prefusing rollers, the second prefusing roller being positioned to contact the first prefusing roller and create a first nip area between the first and second prefusing rollers, wherein at least one of the first and second prefusing rollers is heated to a temperature that provides a prefusing temperature within the first nip area. The apparatus further includes a second fusing station spaced from the first fusing station and having first and second final fusing rollers, the second final fusing roller being positioned to contact the first final fusing roller and create a second nip area between the first and second final fusing rollers, wherein at least one of the first and second final fusing rollers is heated to a temperature that provides a fusing temperature within the second nip area. The fusing temperature of the second nip area is preferably higher than the prefusing temperature of the first nip area.

The fusing apparatus may be included within an electrophotographic printing device, wherein the first and second prefusing rollers of the first fusing station are positioned within the printing device to contact an image on a substrate prior to the first and second final fusing rollers of the second fusing station contacting the image on the substrate. At least one of the first and second prefusing rollers may be maintained at a temperature between about 100° C. and about 150° C., and at least one of the first and second final fusing rollers may be maintained at a temperature between about 130° C. and 220° C. The first and second fusing stations may be contained within a single fusing unit. Further, the fusing apparatus may further include a cooling element for cooling at least one of the rollers of the first and second fusing stations, such as a fan.

In another aspect of the invention, a method of fixing images made from a liquid toner onto a substrate within an electrophotographic printing device is provided. The method includes the steps of placing a liquid toned image on at least one surface of a substrate and moving the substrate through a first fusing station, the first fusing station comprising a first prefusing roller and a second prefusing roller positioned to contact the first prefusing roller and create a first nip area, wherein at least one of the first and second prefusing rollers is heated to a temperature that provides a prefusing temperature within the first nip area. The substrate then moves through a second fusing station, the second fusing station being spaced from the first fusing station and comprising a first final fusing roller and a second final fusing roller positioned to contact the first final fusing roller and create a second nip area, wherein at least one of the first and second final fusing rollers is heated to a temperature that provides a fusing temperature within the second nip area, wherein the fusing temperature of the second nip area is higher than the prefusing temperature of the first nip area.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Toner materials commonly used in electrophotography can be generally divided into the categories of dry toners and liquid toners. The term "dry" is not meant to refer to a toner that is totally free of any liquid constituents, but refers to toner particles that do not contain a significant amount of solvent. For typical dry toners, the amount of solvent would typically be less than 10 weight percent solvent, for example, and may be less than 8 weight percent solvent or even less than 5 weight percent solvent, where solvent content is preferably as low as is reasonably practical for a particularly dry toner. In contrast, a typical liquid toner composition of the type used in the methods and systems of the present invention generally includes toner particles that are suspended or dispersed in a carrier liquid. The carrier liquid is preferably a nonconductive dispersant liquid, where this lack of charge carrying capability is desirable to avoid discharging any latent electrostatic images during the printing process. Liquid toner particles are preferably solvated or stabilized (i.e., dispersed and suspended) to some degree in the carrier liquid, typically in more than 50 weight percent by total weight of the toner, of a low polarity, low dielectric constant, substantially nonaqueous carrier solvent. The liquid toner particles are preferably chemically charged using polar groups that dissociate in the carrier solvent, but the toner particles preferably do not contain a triboelectric charge while solvated and/or dispersed in the carrier liquid. Because liquid toners often contain particles that are smaller in size than the particles in a dry toner, liquid toners of the type used in the present invention are often capable of producing toned images with a higher resolution than those produced by dry toners.

Figure 1:
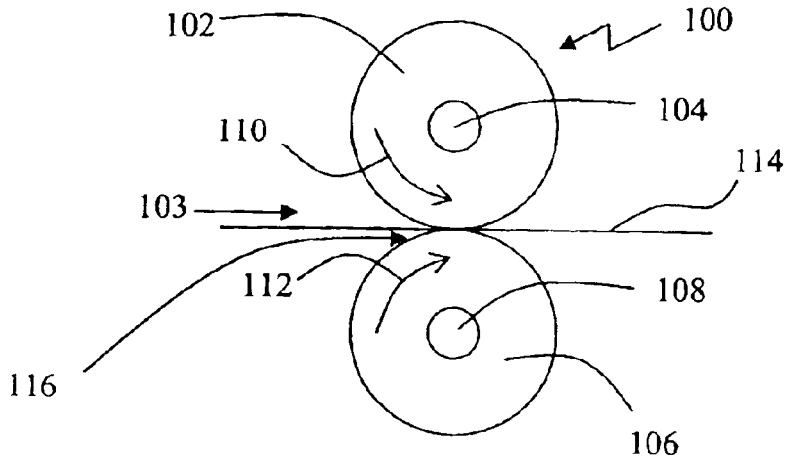
FIG. 1 is a side schematic view of a prior art fusing apparatus as is typically used in the dry toner art.

Referring now to the Figures, wherein the components are labeled with like numerals throughout the several Figures, and initially to FIG. 1, a schematic view of one typical fuser apparatus 100 used in dry toner applications is illustrated, which generally includes a first roller 102, a second roller 106, and a substrate 114 moving in a direction generally shown by the arrow 103. The first roller 102 can be heated internally, such as by a heating element 104, which may be a halogen lamp, for example, although other heating elements may be used, including heating blankets and heating lamps. The backup roller 106 is positioned to be in contact with the first roller 102, thereby creating a contact nip 116 between the rollers 102 and 106 that is sufficiently loose to accommodate the thickness of substrate 114. In many cases, the backup roller 106 is also heated by a heating element 108 similar to that used with the first roller 102. At least one of the rollers is typically driven by a driving mechanism (not shown), and the rollers 102, 106 rotate as generally shown by arrows 110, 112, respectively. Substrate 114 with non-fused or toned images on one side is typically provided to the nip area 116 and conveyed through this nip area 116 in the direction 103 so that the combined heat from the rollers 102, 106 melts the toner, fusing it onto the substrate 114. The image (not shown) can face either of the rollers 102, 106 if both are heated, but typically faces the heated roller if only one of the rollers is heated.

Figure 2:
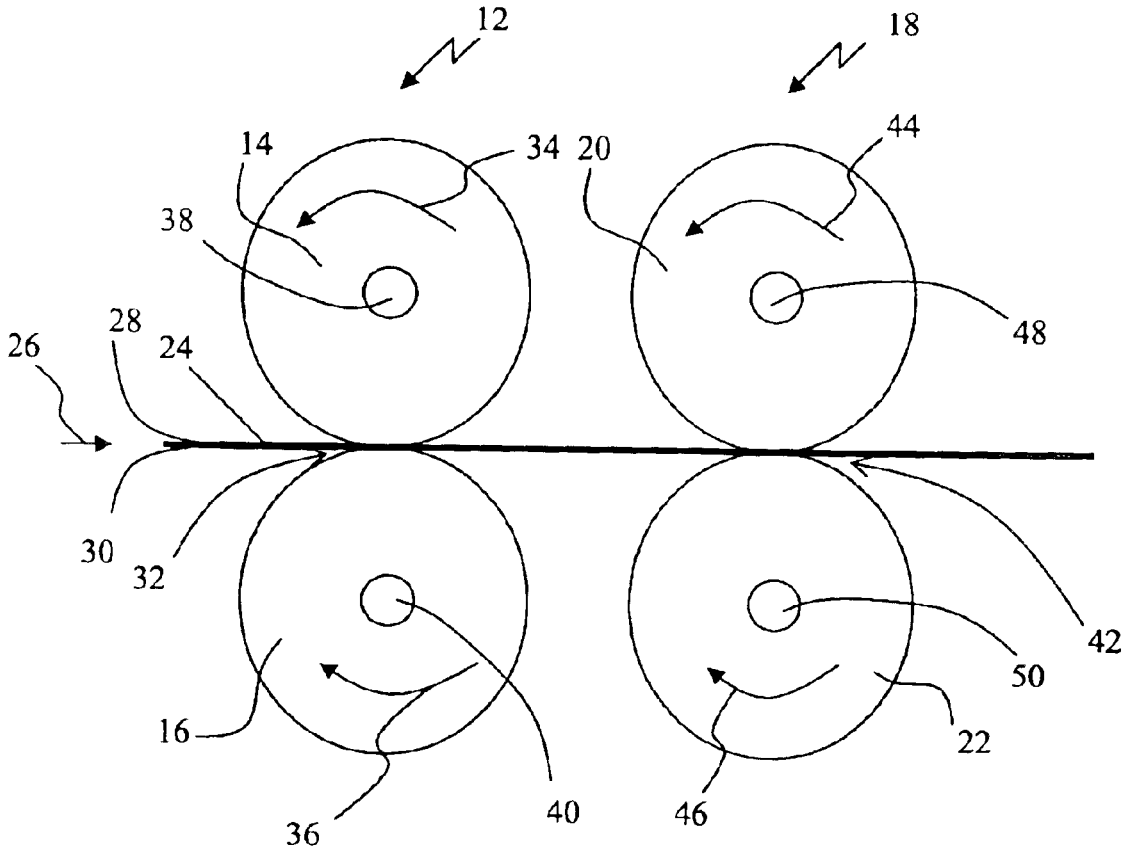
FIG. 2 is a side schematic view of one embodiment of the fusing apparatus of the present invention.

In accordance with one preferred embodiment of the present invention, the fuser apparatus or system shown in FIG. 2 accommodates the requirements of liquid toner fusing by providing a way of "prefusing" a liquid toner prior to fixing or fusing the image to a substrate. In particular, the present invention provides an initial processing step for evaporating at least a portion of the carrier liquid at a temperature that is low enough to keep the toner from sticking or "offsetting", and at a temperature that is high enough to provide a desired amount of carrier liquid evaporation. This initial step can greatly enhance image quality and durability achieved on the substrate after at least one additional fusing step. As shown particularly in the embodiment of FIG. 2, a fuser apparatus or system 10 is provided, which generally includes a first fusing station 12 including a pair of prefusing rollers 14 and 16, and a second fusing station 18 including a pair of final fusing rollers 20 and 22. As shown in this figure, a substrate 24 is traveling in a direction shown by the arrow 26. In accordance with the invention, the substrate 24 will be provided to the system 10 with a non-fused or toned image formed by a liquid toner on at least one side of the substrate 24. The image will preferably be fused to the substrate 24 after passing through the system 10 using the methods and systems described below.

More specifically, the pair of prefusing rollers 14 and 16 of the first fusing station 12 are arranged to evaporate at least an initial portion of a carrier liquid from a liquid toned image on the substrate 24. The rollers 14 and 16 are preferably positioned relative to each other in such a way to provide a nip area 32 between them. This nip area 32 is the area or region where the two rollers 14 and 16 are in contact with each other, which determines the length of time during which a moving substrate will contact the fusing rollers as it passes through the nip area (i.e., dwell time). Because the rollers 14 and 16 are preferably in contact across the entire lengths of both rollers, the size of the nip area is mainly controlled by adjusting the width of the contact area in the travel direction of the substrate. The size of the nip area 32 may be controlled, for example, by adjusting the hardness of one or more of the roller layers of either or both of the rollers, and/or by increasing or decreasing the force or pressure that is pressing the rollers 14 and 16 toward each other. For example, the size of the nip area 32 can be decreased by increasing the hardness or durometer of at least one of the rollers 14 and 16, and/or decreasing the pressure applied to the two rollers. These parameters and adjustments should preferably be chosen to accommodate the thickness and various other material properties of any substrates that will pass through the nip area 32. For one example, although a relatively thin material may be able to pass through a relatively tight or high-pressure nip area, it is also important that the rollers are not pressed so hard toward each other that the substrate will tend to wrinkle or tear when passing through the nip area. In one preferred embodiment of the present invention, the nip width is in the range of 0.5 mm to 3 mm, with a more preferred range being 1.5 mm to 2.5 mm.

As described above, the amount of time the substrate 24 can spend in the nip area 32 may be at least partially controlled through selection of the durometer or hardness of the outer coating or rubber layers of the rollers 14 and 16, or the hardness of the rollers themselves if no coating layers are provided. The hardness of the coating layers (e.g., rubber layers with or without any overcoat or release layers) is important because if the roller is too soft, the coating may bend, which may cause cracking or delamination of the coating. In addition, the substrate to which the toner is being fused might also bend and distort if the hardness of the rollers is too low. If the rollers are relatively hard, the nip area 32 will be relatively small and the duration of time that heat may be applied to the toner and substrate will be reduced, which may result in insufficient fixation of the toner to the substrate and/or insufficient evaporation of solvent. Furthermore, a nip 32 that is provided between rollers that are too soft and/or have too wide of a nip area may tend to cause the final substrate to wrinkle and may trap evaporated solvent between the rollers 14 and 16. In contrast, a nip 32 that is provided between rollers that are too hard and/or have too narrow of a nip area may not provide enough contact time between the rollers and the image to evaporate a sufficient amount of the solvent.

The hardness or durometer of each roller is determined by the cumulative hardness of all of the layers of materials (e.g., rubbers, silicones, release coatings, and the like) that make up the structure of that roller. While rollers that have a relatively low durometer are softer and therefore create a wider nip that allows for a longer period of time for substrate contact with the rollers, these rollers are often less durable and are therefore more likely to break down from heat and constant use. In contrast, a higher durometer roller will be harder and therefore create a narrower nip that provides a shorter time for substrate contact with the rollers. These harder rollers will, however, typically be more able to withstand heat for longer periods of use. Thus, rollers are preferably selected to balance the need for a certain nip width for fusing performance with the desired time that a particular roller can be used before being replaced. The overall hardness of the coating layers on the rollers is preferably in a range between 5 and 50 Shore A hardness, but more preferably is in a range between 10 and 30 Shore A hardness. The rollers 14 and 16 may have the same hardness, or the rollers may differ from each other in hardness.

The rollers 14 and 16 may be made by a wide variety of manufacturers, including rollers commercially available from Bando USA Inc. (Itasca, Ill.), Bando International (Chuo-Ku, Kobe, Japan), Minco Manufacturing (Colorado Springs, Colo.), and Ames Rubber Co. (Hamburg, N.J.). Several important characteristics that are preferably considered in the selection of rubbers used on fusing rollers include: the durability at a particular temperature, including scratch and solvent resistance for liquid electrophotography, the compliance for optimal nip residence time; and, in many cases, the ability to act as an adherent substrate for any sort of a release or low surface energy layer which may be applied. Examples of rubbers and compositions, along with parameters that may be considered in the selection thereof, are described, for example, in U.S. Pat. Nos. 5,974,295 (De Neil, et al.) and 6,602,368 (Geiger). Coatings can be included on at least one of the fuser rollers such as rollers 14 and 16 to allow the toner particles to release easily from the surface, even after heating of the toner particles. Fluoroelastomers and polydimethyl siloxanes are two examples of coatings that may be used for such applications because of their low surface energies. For example, dimethyl siloxane tends to rapidly increase in surface energy at higher temperatures, which can thereby cause offset, and is therefore more effective at lower temperatures, as in the first fusing station 12. For another example, the coating commonly referred to under the trade name "Teflon" can be used without causing offset in fusing stations where the rollers are at a relatively high temperature, such as in the second fusing station, as will be described in further detail below.

If a roll base is used without additional release coatings, the base rubber or material preferably has a low enough surface energy that the toner does not tend to stick to the base material when the substrate exits the nip area 32 between rollers 14 and 16. Some examples of rubbers and materials that can meet these requirements include fluoroplastomers, fluoroelastomers, polysiloxane elastomers, polyurethanes, and ethylene-propylene elastomers, where some of these materials are more effective than others at higher temperatures due to surface energy changes. Fillers may also be employed to enhance electrical or thermal conductivity, as in the case of fusing systems that heat to their operating temperature very rapidly (i.e., "instant on" applications). For one example, aluminum roller cores can be used, which cores can be coated with about 1–2 mm of silicone rubber having a hardness of 10 and 30 Shore A. The rubber can also be coated with about 0.025 mm to 0.050 mm of polydimethyl siloxane, for example, as a release coating.

Another factor used in designing a nip area 32 is the selection of a pressure with which the two rollers 14, 16 will press against one another and a substrate 24. The pressure to which the substrate 24 is subjected as it passes through the nip area 32 can affect the print quality. For instance, if there is insufficient pressure, the image may be smeared in the nip or an insufficient amount of solvent may evaporate. If there is too much pressure, the substrate 24 may be damaged or destroyed. In one embodiment of the invention, the pressure between the rollers is preferably maintained in a range between 10 pounds (4.5 kg) and 60 pounds (27.2 kg) of total pressure, and more preferably is maintained in a range between 20 pounds (9.1 kg) and 45 pounds (20.4 kg) of total pressure. The preferable pressure may also be defined as approximately 2.2 to 5.0 pounds per lineal inch, depending on the desired pressure parameters. However, the pressure may be substantially lower or higher than this range, depending on the other selected parameters of a particular desired nip area, including the rollers used, the liquid toner formulation, and the substrate onto which an image is applied. The rollers 14 and 16 may have different diameters from each other; however, the roller materials used and the pressures selected may be different than if the rollers were the same diameter. In such an embodiment where the roller diameters are different from each other, the rollers may rotate at different speeds from each other, where one or both of the rollers may be driven, depending on the roller configuration.

As described above, the arrow 26 of FIG. 2 shows the direction the substrate 24 is moving in this embodiment. To facilitate such movement of the substrate 24, the rollers 14 and 16 rotate in the directions shown by arrows 34 and 36, respectively. One or both of these rollers 14, 16 may be driven by a driving mechanism (not shown) of any type capable of providing the desired movement of the substrate 24 through the system 10. A liquid toned image may be provided on at least one of an upper surface 28 and a lower surface 30 of substrate 24 when that substrate 24 is fed into the nip 32. The roller that faces the image or images, whether it is roller 14, roller 16, or both rollers 14 and 16 if the image is printed on both sides of the substrate 24, should be heated to provide a temperature in the nip area 32 that will preferably allow at least a portion of the carrier liquid to evaporate and will more preferably cause a substantial portion of the liquid to evaporate.

When a toned image is provided on a single surface of the substrate 24, it is preferred that the toned image faces upwardly or substantially upwardly, because the carrier liquid will typically rise and move away from the substrate 24 as it evaporates, with the majority of the vapor being concentrated at or near the surface of the outer portion of the image. For example, in this first fusing station 12, the image would preferably face roller 14, but if the fuser apparatus required a vertical or substantially vertical paper path, the direction the liquid toned image on the final substrate would face would be less critical. If the toned image is facing downwardly (in this case, toward the roller 16), the rising evaporated carrier may be at least partially re-absorbed into the substrate 24 or image or trapped underneath the substrate 24, where it might condense. However, a substrate provided with a toned image facing down is considered to be within the scope of the present invention, although the amount of toner evaporation may differ from those situations where the image is facing upwardly. In these situations, the size of the nip area and the temperature of the rollers may need to be adjusted accordingly. Thus, if the toned image is facing down in a system such as that shown in FIG. 2, various parameters of the system (e.g., temperature, pressure, etc.) may be adjusted to different levels than when the toned image is facing up in the system in order to achieve the same amount of carrier liquid evaporation.

In order to heat the rollers 14 and/or 16 of the station 12 to a desired temperature, a variety of heating methods and devices may be used. One example of a heating element that can be used to heat the various rolls of the present invention is a quartz halogen lamp, although other known means may be used to keep the rollers evenly heated. Halogen lamps provide certain advantages because they heat quickly and evenly, become very hot, and have a relatively long life.

They can also be situated within a hollow core of a fuser roller without requiring contact with the roller itself, which is a feature that may help reduce the chance of mechanical failure associated with a loss of contact. In the embodiment of FIG. 2, for example, rollers 14 and 16 are provided with internal heating elements 38 and 40, respectively, which may be halogen lamps or other heat sources. When such internal heating sources are used, the rollers 14 and 16 may include metal cores coated with heat-resistant rubber and a very low surface energy coating, such as silicone.

Another parameter that can be adjusted and controlled in the first fusing station 12 to achieve a certain amount of liquid carrier evaporation is the temperature of the rollers 14 and 16. Either one or both of these rollers 14 and 16 can be heated as necessary to provide a relatively constant amount of heat to the substrate 24. In situations where only a small amount of heat needs to be transferred to the substrate for carrier liquid evaporation, for example, only one of the rollers 14, 16 may need to be heated, or it may be possible for both rollers 14, 16 to be heated to a relatively low temperature to achieve the same level of evaporation. Because the process of evaporation may tend to cool one or both of the rollers during the prefusing or evaporation process in this first fusing station 12, one or both of the rollers 14, 16 may be provided with a feedback system to regularly monitor and adjust the amount of heat provided by the heat source or sources to maintain the temperature of the rollers within a desired range. Although the preferable temperature of the prefusing roller(s) is determined primarily by the liquid toner characteristics, the vaporization point of the chosen carrier liquid, and the fuser roller coating parameters, one preferred temperature range for the rollers 14 and 16 is between about 100° C. and 150° C., with a more preferable temperature range of the rollers being maintained between about 110° C. and 130° C.

The fusing apparatus or system of FIG. 2 further includes a pair of fixation or fusing rollers 20 and 22 as part of the second fusing station 18. The fixation or fusing rollers 20, 22 are placed to contact substrate 24 and the toned image or images on one or more of its surfaces 28, 30 at some point after the rollers 14, 16 of the first fusing station 12 have heated the substrate 24 and caused at least a portion of the carrier liquid to evaporate. Again, the arrow 26 shows the direction of movement of the substrate 24, which also shows the direction the substrate moves into the station 18. The spacing between the fusing station 12 and the fusing station 18 is preferably as small as possible to help to minimize the amount of fusing space required in the printing unit. However, it may also be desirable to provide at least a certain predetermined distance between the stations 12 and 18, such as to keep the heat from one fusing station from affecting the heat provided by rollers in the other fusing station.

Once the substrate 24 has at least partially passed through the nip 32 of station 12, it is conveyed to move forward, then pass into a fusing or fixation nip 42 between the rollers 20 and 22. To facilitate such movement of the substrate 24, the rollers 20 and 22 rotate in the directions shown by arrows 44 and 46, respectively. The rollers 20, 22 within a particular system 10 may be the same or different from the rollers 14, 16 used in station 12 in size, durometer, rubber/coating thicknesses, and/or other parameters. Because the various toned images and the substrates on which they are to be fused can vary widely, the features and positioning of the rollers 20, 22 can also include many different characteristics and spacings relative to each other in the same way that the rollers 14, 16 can include a wide variety of characteristics and spacings relative to each other. Thus, the various alternatives and considerations described above relative to the rollers 14, 16 are applicable to the rollers 20, 22 of the second fusing station 18.

The rollers 20, 22 preferably heat the toner particles to a temperature above their glass transition temperature ($T_g$) relatively quickly to provide the desired final fusion of toner particles to the substrate 24. Thus, these rollers are usually maintained at a higher temperature than the rollers 14, 16, which are mainly designed to provide carrier liquid evaporation so that the substrate reaches the second fusing station 18 with a relatively dry toned image (i.e., relatively free of solvent). In order to maintain these relatively high temperatures, it is therefore preferable that both of the rollers 20, 22 are provided with a heat source, although it is possible that only one of the rollers has its own heat source. In the embodiment of FIG. 2, for example, rollers 20 and 22 are provided with internal heating elements 48 and 50, respectively, which may be halogen lamps or other heat sources, such as are described above for the heat sources 38 and 40.

One preferred range of fusing temperatures for the nip area 42 between the rollers 20, 22 is between 130° C. and 220° C.; however, some liquid toners are more preferably fused at a temperature above 150° C. The fusing temperature is preferably not so high that it causes "offset" or transfer of the image to either of the fusing rollers. The fusing rollers 20, 22 may therefore be manufactured with the same core and material layers as the rollers 14 and 16 of the first fusing station 12; however, a release layer can be included on rollers 20, 22 that has a relatively high surface energy, where such release layer may be provided in the form of a molded sleeve. Thus, because the image has been partially fused and a considerable portion of the carrier liquid will have been evaporated by the time the substrate reaches the second fusing station 18, this fusing station 18 may include rollers having materials that can withstand higher temperatures than the materials used in the first fusing station 12, such as sleeves or coatings available under the trade name "Teflon". In one exemplary embodiment of the present invention, the thickness of a coating layer on the rollers 20, 22 can be about 0.025 mm to 0.050 mm, and the total diameter of the rollers can be about 35 mm with a Shore A hardness between 10 and 30. Further with regard to this exemplary embodiment, the rollers 20, 22 preferably have a total pressure applied between them of between 10 pounds (4.5 kg) and 60 pounds (27.2 kg) to create a nip 42 in a range of 1 mm to 3 mm, and more preferably is maintained in a range between 20 pounds (9.1 kg) and 45 pounds (20.4 kg) of total pressure. As with the rollers in the first station, the pressure may also be defined as approximately 2.2 to 5.0 pounds per lineal inch.

The apparatus of the present invention may be constructed such that the two pairs of rollers of the two fusing stations 12 and 18 are independently positioned and operated within the electrophotographic unit, or they may be built into a single unit that is exchangeable as a single component of a larger system. One consideration for either construction is the distance between rollers 14 and 20 and between rollers 16 and 22. Because each of the rollers rotates in the same direction as one of the rollers in the other station (as indicated by arrows 34, 36, 44, and 46), rollers 14 and 20 and rollers 16 and 22 preferably do not touch. Depending on the space limitations of the printer unit in which the fusing system 10 is used, the distance between the rollers of the stations 12 and 18 may be in the range of 1 to 12 inches; however, the distance between the rollers of the two stations may be less than 1 inch, particularly in space-restrictive systems or systems with relatively small rollers, or may be more than 12 inches, particularly in large, commercial units or systems with relatively large rollers.

In one preferred embodiment of the present invention, the diameter of all of the rollers 14, 16, 20, and 22 is approximately 35 mm, but this size is primarily chosen to accommodate the size of the electrophotographic apparatus. The rollers may be the same or different sizes than each other, both within a station and between the stations. A lower limit on roller diameter may be constrained at least by the need for rigidity of the rollers and sometimes by the need for a hollow space inside in which to insert heating elements while maintaining sufficient structural strength for the rollers.

Figure 3:
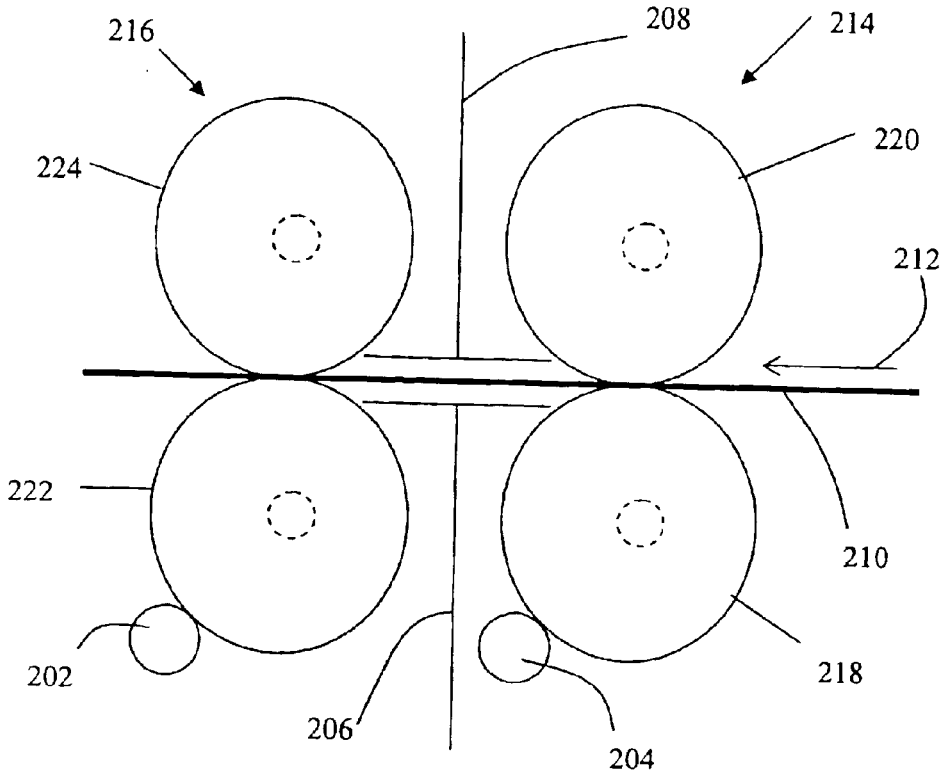
FIG. 3 is a side schematic view of another embodiment of the fusing apparatus of the present invention.

Because the substrate 24 passes through two nips 32, 42 sequentially, it is preferable to maintain a constant speed or velocity of the rollers 14, 16, 20, 22 to prevent wrinkling, tearing, or other damage to the substrate 24. There are several ways to drive the rollers, such as by driving the cores of the rollers 14, 16, 20, and/or 22 with gears or attached motors. Another way is shown in the embodiment of FIG. 3, which shows the addition of drive rollers 202 and 204 to the embodiment of FIG. 2, with a substrate 210 moving in a direction 212 through a first fusing station 214 including rollers 218 and 220, and then a second fusing station 216 including rollers 222 and 224. In particular, drive roller 204 contacts the surface of roller 218 to rotate this roller 218 in a direction that is opposite that of the drive roller 204. Further, the drive roller 202 similarly contacts the surface of roller 222 to rotate this roller 222 in a direction that is opposite the rotation of drive roller 202. In this embodiment, drive rollers 202 and 204 can be engaged by either individual motors or drive systems, or can both be driven by the same motor or drive system (not shown).

In addition, FIG. 3 illustrates an additional optional feature of a system of the present invention that is particularly designed to help maintain the flatness of the substrate 24 as it moves from the first fusing station 12 to the second fusing station 18. In particular, one or more guides, such as those shown schematically as guides 206, 208, may be provided on one or both sides of the substrate 24 to keep the substrate from curling or bending after being exposed to heat in the first fusing station 12. These guides 206, 208 may take any number of forms that do not damage the toned image or interfere with the movement of the substrate, but prevent or minimize folding or mutilation of the substrate as it enters the nip area 42. While these guides are illustrated in the embodiment of FIG. 3, such guides may be used in any other embodiments of the present invention, such as the embodiment shown in FIG. 2.

It is important that a fuser unit containing systems of the type shown in FIGS. 2 and 3 maintain adequate airflow to allow evaporated solvent and excess heat to escape. Evaporated solvent that is trapped in the fuser unit can re-condense or become re-absorbed into the final substrate or image, thereby destroying image quality. For this reason, the apparatus should preferably have an adequately open construction that allows solvent to escape. Additionally, a fan or other air-moving device can be positioned to draw evaporated solvent from the area and/or to cool at least one of the rollers or the substrate, such as to help maintain the rollers and substrate within a preferred temperature range.

The embodiments of the present invention described above include two fusing stations, with the first station preferably including rollers that are held at a lower temperature than the rollers of the second station. It is understood, however, that the first fusing station may instead have rollers that are held at a higher temperature than the rollers of the second station, or that the rollers of the first fusing station and the rollers of the second fusing station are held at the same or very similar temperatures to each other. Further, one or both of the rollers in each fusing station can be heated. It is further contemplated that a fusing system of the present invention may include more than two fusing stations, where stations that are intermediate to the initial and final fusing stations may each include additional fusing rollers that are provided at different or similar temperatures to the rollers of the other fusing stations. Because the additional fusing stations will necessarily require more processing space, however, it will typically be desirable to limit the number of fusing stations as much as possible to limit the overall size of the machines or apparatuses.

The operation of the present invention will be further described with regard to the following detailed examples. These examples are offered to further illustrate the various specific and preferred embodiments and techniques. It should be understood, however, that many variations and modifications may be made while remaining within the scope of the present invention. The fusing apparatus system arrangements used and tests conducted were as follows:

THE EXAMPLES

The apparatus was designed to meet the following specifications. The first fusing station and the second fusing station were housed together in one unit to save space and facilitate easy exchange of fusing units.

The first fusing station comprised two 35 mm diameter rollers each made of a metal core, a silicone rubber (or urethane rubber) base layer of 1–2 mm, and a release coating layer of polydimethyl siloxane over the base layer that was 0.025 mm to 0.050 mm thick. The durometer of the base and coating layers together was between 10 and 30 Shore A hardness. The rollers were hollow and heated from the inside by halogen lamps to between 110° C. and 130° C. Gears were included in the housing to turn the rollers.

The second fusing station comprised two 35 mm diameter rollers each made of a metal core, a silicone rubber base layer of 1–2 mm, and a release layer made of a molded-in-place Teflon sleeve having a thickness of 0.025 mm to 0.050 mm thick. The durometer of the base and coating layers together was between 10 and 30 Shore A hardness. The rollers were hollow and heated from the inside by halogen lamps to between 150° C. and 170° C. Gears were included in the housing to turn the rollers.

The housing was carefully designed to mesh the gears so the rollers turned at the same speed and to keep the rollers pressed together at a constant pressure of about 20 to 30 pounds. Because all four rollers were turning the same direction, care was taken that the pairs of rollers at each station did not touch. Thus, the rollers of the two stations were spaced about 2 inches from each other.

Tests were run using both a single-roller fusing system designed for dry toner fusing, and using the dual roller fuser. The results are shown in the table and discussed below.

Test Methods and Apparatus

In the practice of the invention, the following test methods were used to determine the quality of printing transferred to a substrate:

Erasure Resistance:

In order to quantify the resistance of the printed ink to erasure forces after fusing, an erasure test has been defined.

This erasure test consists of using a device called a Crockmeter to abrade the inked and fused areas with a linen cloth loaded against the ink with a known and controlled force. When the linen cloth has been fixtured onto the Crockmeter probe, the probe is placed onto the inked surface with a controlled force and caused to slew back and forth on the inked surface a prescribed number of times (in this case, 5 times by the turning of a small crank with 5 full turns at two slews per turn). The inked test area was long enough so that during the slewing, the erase head never left the inked surface by crossing the ink boundary and slewing onto the paper surface.

The Crockmeter used in this testing was an AATCC Crockmeter Model CM1 manufactured by Atlas Electric Devices Company, Chicago, Ill. 60613. The head weight of this device was 934 grams, which is the weight placed on the ink during the 5-slew test, and the area of contact of the linen cloth with the ink was 1.76 $cm^2$. The result of this test is a ratio of measurements of the density of ink on the linen abrading cloth after 5 slews on the printed ink test sample at the applied force per unit area of 530 $g/cM^2$ to the original density of the ink on the paper before testing. In order to pass this erasure test, the density of the erased (test) area must be at least 95% of its original density. Otherwise, the process will be judged to fail and will be designated to have inadequate erasure resistance. The actual calculation is as follows:

$$\text{ERASURE}=(OD_{print-ODcloth})/(OD_{print})\times 100\%,$$

where $OD_{print}$ is the original optical density of ink on the print or substrate and $OD_{cloth}$ is the optical density of ink on the abrading cloth after the 5 slew test.

These tests are conducted frequently on random printed and fused images to ascertain consistency in image durability and were used with the following invention to benchmark success or failure of the embodiments with various liquid toner formulations.

Offset

Offset occurs when part of the toned image on the substrate is transferred from the substrate to a fusing roller. There are two types of offset. Cold offset occurs when the fusing rollers are not hot enough to evaporate the solvent and change the rheology of the toner so that it will fuse to the substrate. Hot offset occurs when the fusing rollers are too hot and the toner is melted, but comes off on the fusing roller. In either case, the image is damaged and will not achieve a rating of 0 (no offset), which is the only acceptable rating in the printing industry. Following are the ratings and definitions thereof used in this analysis:

Offset ratings:

0=no offset,

1=very slight, rare,

2=occasionally noticeable (every 10–12 pages),

3=noticeable (every 4–5 pages),

4=noticeable most of the time, toner is redeposited on the substrate downstream from where it was removed, 5=large pieces of image offset constantly, continuous re-depositing of toner image downstream on substrate.

The following results were obtained from a fusing device configured like the one seen in FIG. 1 (prior art) made for dry toner fusing applications. They are demonstrative of the problems faced when trying to fuse liquid electrophotographic toners. That is, using a fusing system designed for dry toner fusing processes, there is no apparent solution space for prints that have both adequate erasure resistance and no offset.

Single-Station (One Roller Pair) Fusing

| Type of Roller coating used | Roller temperature | Erasure Resistance | Offset |
|---|---|---|---|
| Rubber roller from Bando with a highly absorptive polydimethyl siloxane coating Shore A hardness 10 | 75° C. | No data | Cold offset: 5 |
| | 100° C.–110° C. | 85% | Hot offset: 1 |
| | 120° C.–130° C. | 95% | Hot offset: 3 |
| | 145° C.–160° C. | 97% | Hot offset: 4 |

Double Station (Two Roller Pairs) Fusing

In accordance with the practice of this invention, such as the system 10 shown in FIG. 2, the two rollers used for this testing included: Roller 1, having a high absorbancy polydimethyl siloxane coating (for low surface energy and a low cold offset temperature), and Roller 2, having a Teflon® sleeve over the rubber (to provide for low surface energy and a high hot offset temperature). These sleeves are also very durable for long periods of time at the relatively high temperatures needed to adequately fuse an image.

| Roller(s) used | Roller temperatures | Erasure Resistance | Offset |
|---|---|---|---|
| Roller 1 | 95° C. | 77% | 0 |
| Roller 2 | 180° C. | 90% | 5 |
| Roller 1/Roller 2 | 90° C./180° C. | 98% | 1.5 |
| Roller 1/Roller 2 | 95° C./180° C. | 98% | 0 |
| Roller 2/Roller 2 | 50° C./180° C. | 90% | 0 |

From this data and the observations of the tests performed, it was observed that the first roller evaporated and/or absorbed the majority of the carrier liquid, which allowed the second roller to adequately fuse the image without offset. This was accomplished by careful selection of coating/release materials. For example, the performance of the system was better, even at cooler temperatures, when at least one roller of the first station had a coating with a low surface energy and that was at least somewhat absorbent (so that at least some of the carrier liquid that absorbed into the coating layer could provide lubrication and release properties), and when at least one roller of the second station had a coating that was durable and able to withstand high heat for long periods of time without substantially changing surface energy characteristics.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

What is claimed is:

1. A fusing apparatus for fixing images made from a liquid toner onto a substrate using an electrophotographic process, the apparatus comprising:

a first fusing station comprising first and second prefusing rollers, the second prefusing roller being positioned to contact the first prefusing roller and create a first nip area between the first and second prefusing rollers, wherein at least one of the first and second prefusing rollers is heated to a temperature that provides a prefusing temperature within the first nip area; and a second fusing station spaced from the first fusing station and having first and second final fusing rollers, the second final fusing roller being positioned to contact the first final fusing roller and create a second nip area between the first and second final fusing rollers, wherein at least one of the first and second final fusing rollers is heated to a temperature that provides a fusing temperature within the second nip area;

wherein the fusing temperature of the second nip area is higher than the prefusing temperature of the first nip area.

2. The fusing apparatus of claim 1, wherein at least one of the first and second prefusing rollers comprises a heat conductive core and a heat source for controlling the temperature of the heat conductive core.

3. The fusing apparatus of claim 1, wherein at least one of the first and second final fusing rollers comprises a heat conductive core and a heat source for controlling the temperature of the heat conductive core.

4. The fusing apparatus of claim 1 in combination with an electrophotographic printing device, wherein the first and second prefusing rollers of the first fusing station are positioned within the printing device to contact an image on a substrate prior to the first and second final fusing rollers of the second fusing station contacting the image on the substrate.

5. The fusing apparatus of claim 1, wherein the first nip area is aligned with the second nip area, and wherein the first and second prefusing rollers are spaced from the first and second final fusing rollers.

6. The fusing apparatus of claim 1, wherein at least one of the first and second prefusing rollers is maintained at a temperature between about 100° C. and about 150° C.

7. The fusing apparatus of claim 1, wherein at least one of the first and second final fusing rollers is maintained at a temperature between about 130° C. and 220° C.

8. The fusing apparatus of claim 1, wherein at least one of the first and second prefusing rollers comprises a layer with a surface energy less than a surface energy of the liquid toner.

9. The fusing apparatus of claim 8, wherein the outer layer is a silicone release coating layer.

10. The fusing apparatus of claim 1, wherein at least one of the first and second final fusing rollers comprises an outer layer with a surface energy less than a surface energy of the liquid toner.

11. The fusing apparatus of claim 10, wherein the outer layer is a fluorinated polymer release coating layer.

12. The fusing apparatus of claim 1, wherein the first and second prefusing rollers are heated to the same temperature.

13. The fusing apparatus of claim 1, wherein one of the first and second prefusing rollers is positioned to contact an image on the substrate, wherein the roller that is positioned to contact the image is heated to a higher temperature than the roller that is not positioned to contact the image.

14. The fusing apparatus of claim 1, wherein the first and second final fusing rollers are heated to the same temperature.

15. The fusing apparatus of claim 1, wherein one of the first and second final fusing rollers is positioned to contact an image on the substrate, wherein the roller that is positioned to contact the image is heated to a higher temperature than the roller that is not positioned to contact the image.

16. The fusing apparatus of claim 1, wherein the first and second fusing stations are contained in a single fusing unit.

17. The fusing apparatus of claim 1, wherein at least one of the rollers of the first and second fusing stations is heated with a halogen lamp.

18. The fusing apparatus of claim 1, further comprising a cooling element for cooling at least one of the rollers of the first and second fusing stations.

19. The fusing apparatus of claim 18, wherein the cooling element is a fan.

20. The fusing apparatus of claim 1, wherein the prefusing temperature is selected to evaporate a predetermined portion of solvent from liquid toner on the substrate.

21. A method of fixing images made from a liquid toner onto a substrate within an electrophotographic printing device having a plurality of fusing stations, comprising the steps of:

placing a liquid toned image on at least one surface of a substrate;

moving the substrate through a first fusing station, the first fusing station comprising a first prefusing roller and a second prefusing roller positioned to contact the first prefusing roller and create a first nip area, wherein at least one of the first and second prefusing rollers is heated to a temperature that provides a prefusing temperature within the first nip area; and moving the substrate through a second fusing station, the second fusing station being spaced from the first fusing station and comprising a first final fusing roller and a second final fusing roller positioned to contact the first final fusing roller and create a second nip area, wherein at least one of the first and second final fusing rollers is heated to a temperature that provides a fusing temperature within the second nip area;

wherein the fusing temperature of the second nip area is higher than the prefusing temperature of the first nip area.

22. The method of claim 21, wherein the step of moving the substrate through the first fusing station further comprises evaporating a predetermined portion of a solvent from the liquid toned image.

23. The method of claim 21, wherein the step of moving the substrate through the first fusing station further comprises providing the liquid toned image on the substrate in a direction so that the image contacts a heated prefusing roller as it moves through the first nip area.

24. The method of claim 21, wherein the step of moving the substrate through the second fusing station further comprises fusing toner particles of the liquid toned image onto the substrate.

* * * * *

UNITED STATES PATENT AND TRADEMARK OFFICE

CERTIFICATE OF CORRECTION

PATENT NO. : 6,996,362 B2
APPLICATION NO. : 10/652898
DATED : February 7, 2006
INVENTOR(S) : Truman F. Kellie et al.

It is certified that error appears in the above-identified patent and that said Letters Patent is hereby corrected as shown below:

Title page,
Item [56], References Cited, U.S. PATENT DOCUMENTS, insert

| | | |
|---|---|---|
| -- 4,727,394 A | 2/1988 | Bov, Jr. et al. |
| 4,745,432 A | 5/1988 | Langdon |
| 4,806,097 A | 2/1989 | Palm et al. |
| 4,935,785 A | 6/1990 | Wildi et al. |
| 5,893,019 A | 4/1999 | Yoda et al. |
| 5,974,295 A | 10/1999 | De Niel et al. |
| 5,987,294 A | 11/1999 | Yoda et al. |
| 6,148,169 A | 11/2000 | Tsukamoto |
| 6,602,368 B2 | 8/2003 | Geiger --. |

Signed and Sealed this

Eleventh Day of July, 2006

JON W. DUDAS
*Director of the United States Patent and Trademark Office*